US005331915A

United States Patent [19]

Snyder

[11] Patent Number: 5,331,915

[45] Date of Patent: Jul. 26, 1994

[54] KAYAK COCKPIT COVER

[76] Inventor: James E. Snyder, Rte. 1, Box 30, Albright, W. Va. 26519

[21] Appl. No.: 986,622

[22] Filed: Dec. 7, 1992

[51] Int. Cl.[5] ..... B63B 35/71

[52] U.S. Cl. ..... 114/347; 114/361; 114/364

[58] Field of Search ..... 114/347, 364, 345, 361; 440/38; 403/5; 256/212

[56] References Cited

U.S. PATENT DOCUMENTS

| | | | |
|---|---|---|---|
| 1,649,311 | 11/1927 | Kaechele et al. | 114/364 X |
| 1,809,455 | 6/1931 | Seitz | 236/242 |
| 3,653,084 | 4/1972 | Hartman | 441/40 |
| 4,583,480 | 4/1986 | Hamilton et al. | 114/347 |

FOREIGN PATENT DOCUMENTS

| | | | |
|---|---|---|---|
| 0424910 | 2/1926 | Fed. Rep. of Germany | 114/347 |
| 1277696 | 9/1968 | Fed. Rep. of Germany | 114/347 |

*Primary Examiner*—Sherman Basinger
*Attorney, Agent, or Firm*—David C. McCandless

[57] ABSTRACT

The invention is a kayak cockpit cover which is complementary to a channel formed in the kayak deck at the cockpit perimeter. The cover has a conventional closure around the kayak paddler's waist and a planar covering section spanning the cockpit opening. An edge assembly at the outer margin of the covering section includes a doubled section of fabric forming an endless sleeve around the cover, an endless resilient inflatable tube carried inside the sleeve, and a valve integral with the tube. A core element within the inflatable tube aids in manipulation of the edge assembly and fixes its length. When the edge assembly is inserted into the channel around the cockpit perimeter and the resilient tube is inflated, a watertight seal is formed as the expansion of the tube presses the skirt edge fabric against the channel interior wall, while the bulk of the inflated tube secures the cover edge to the kayak deck.

14 Claims, 3 Drawing Sheets

KAYAK COCKPIT COVER

BACKGROUND OF THE INVENTION

This invention provides an improved kayak cockpit cover for sealing the cockpit in a kayak of the type having a closed deck with a cockpit opening which accommodates a sitting or kneeling paddler. While the invention relates to kayaks of all types, it is particularly suited to "squirt" kayaks, which are very low volume whitewater kayaks that are designed to be fully submerged at times to experience subsurface currents and turbulence in rivers and streams. Because squirt kayaks have a very low volume and minimal buoyancy, an efficient cockpit seal is a matter of great concern, as even a small amount of water in the boat can affect trim, performance and safety.

A cockpit cover or spray skirt is commonly used to seal the cockpit opening around a kayak paddler so that water will not enter the boat while it is navigated through turbulent water conditions. The cover will generally include a fitted waist closure which seals around the paddler's waist, an adjoining planar section of waterproof fabric covering the cockpit opening, and an elasticized edge on the outside of the planar section which engages a raised rim that is formed as a part of the boat deck. Whitewater kayak cockpits are generally oval-shaped, and most cockpit rims are of the type having a slight vertical projection above the deck and an outward-extending lip which retains the edge of the spray skirt. A typical kayak cockpit cover is shown in U.S. Pat. No. 4,583,480.

The prior art spray skirts, retained on a conventional kayak rim by the tension of an elasticized skirt edge have several inherent deficiencies. First is the problem of water leakage between the skirt and rim, especially under extreme conditions. Water will leak into the kayak where the skirt fabric is not in firm contact with the rim. An area of potential leakage is created where the skirt material becomes bunched or puckered because of the circumferential elastic tension. Also, any discontinuity or deterioration in the elastic material retaining the skirt can cause the skirt to leak. In addition, the area of the seal between the skirt and the rim will be subject to shifts and changes in contact pressure due to the movement of the boater in the boat, and leaking may occur when the cockpit is exposed to large waves or submerged in strong currents.

A second problem with use of the prior art kayak skirt and rim is that kayak design possibilities are restricted. A conventional kayak rim must be circular or oval in shape so that the circumferential pressure of the stretched elastic skirt edge will be evenly distributed. A rim shape using a compound curve or an inside curvature will cause an area of non-contact between the skirt and rim, since the elastic edge of the skirt will follow the shortest distance around rim and bridge across the inside curve. This limitation has been encountered in the design of squirt kayaks where use of a narrow elongated cockpit design can provide increased emergency escapability and boater comfort. Squirt boats are susceptible to underwater pinning, and the elongated cockpit design could avoid entrapment of the paddler's lower legs and allow emergency egress from a submerged kayak. In addition, the fabric cover of an elongated cockpit will provide an area within the confines of the boat where the paddler's feet and legs can be moved while the paddler remains seated. An elongated cockpit design is not practical using the prior art, and many other design possibilities are similarly precluded by the prior art limitations.

A third deficiency which arises from the use of a raised cockpit rim and conventional spray skirt is that the rim itself will interfere with water flowing over the deck of the kayak. This is another matter of particular applicability to squirt kayaks in which it is desireable to have maximum maneuverability while the boat is briefly submerged. An uninterrupted deck surface will provide greater stability as the boat is guided through turbulent water conditions.

Accordingly, an important object of the present invention is to provide a kayak cockpit cover or spray skirt and method of installation which will attain a much higher waterproofing standard than the kayak cockpit covers of the prior art secured by an elastic edge to a raised rim.

Another important object of this invention is to provide a cockpit cover which can be adapted to cockpit shapes and deck configurations other than the flat oval cockpit opening necessitated by use of a conventional spray skirt held in place by circumferential elastic tension.

Still another object of the invention is to provide a cockpit opening and cockpit cover which are nearly flush with the adjacent deck surface and which will allow the kayak to be more hydrodynamically stable when submerged in strong river currents.

SUMMARY OF THE INVENTION

To meet the above objectives, this invention provides a new type of kayak cockpit cover in combination with a kayak deck specially adapted for use with the cover. The cockpit cover has a conventional waist closure and planar covering section along with an improved sealing edge assembly. The sealing edge assembly does not rely on elastic tension to hold the cover in place, and therefore is of fixed length. The edge assembly includes a doubled section of fabric forming an endless sleeve at the perimeter of the cover, an endless resilient inflatable tube carried within the sleeve, and a valve element by which the tube is inflated and deflated.

The cockpit cover of the invention is devised for use with a kayak having a tubular channel molded into the kayak deck at the edge of the cockpit in place of a conventional cockpit rim. The length of the tubular channel is equal to the length of the cockpit cover edge assembly. The tubular channel has inner and outer edges forming a continuous slot of uniform width in the kayak deck around the cockpit. The curved interior wall of the channel joins the inner and outer edges and forms a rounded channel cross section below the deck surface. The width of the slot in the kayak deck formed by the channel edges is smaller than the width of the rounded cross section of the channel below the deck.

When the cockpit cover is used, the waist closure seals the cover at the paddler's waist, the planar covering section is stretched across the cockpit opening, and the sealing edge assembly which contains the inflatable tube is inserted by the paddler into the tubular channel in the boat deck. When the sealing edge assembly has been installed in the channel around the entire perimeter of the cockpit, the tube is inflated by the paddler. A watertight seal is formed as expansion of the inflatable tube presses the fabric of the skirt edge against the curved interior wall of the tubular channel. The bulk of the inflated tube holds the skirt edge firmly within the channel and secures the cockpit cover.

DESCRIPTION OF THE PREFERRED EMBODIMENT

Figure 1:
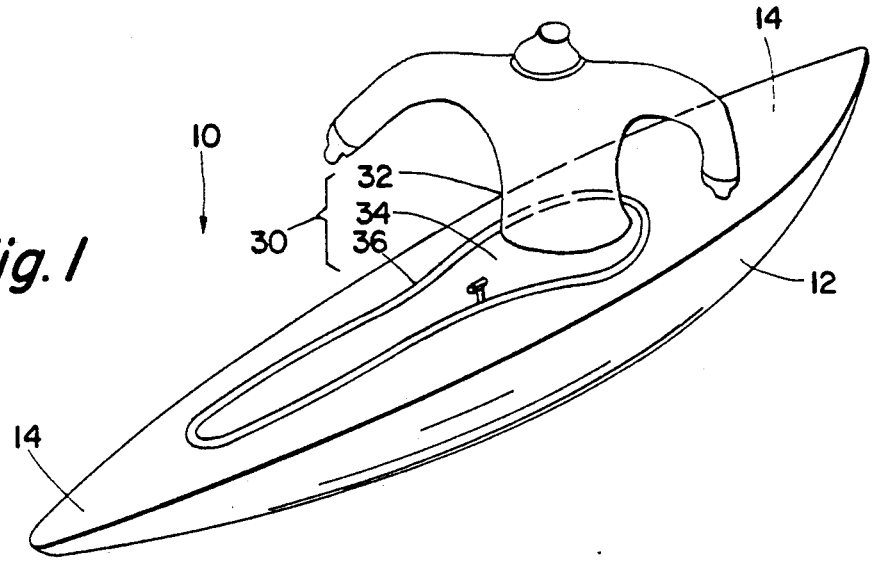
FIG. 1 is a perspective view of the cockpit cover of the invention installed on a kayak having a deck constructed according to the invention.
Figure 2:
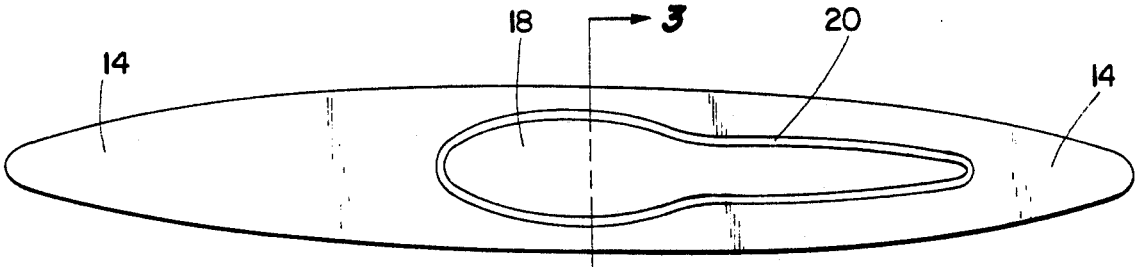
FIG. 2 is a top view of a kayak with its deck constructed according to the invention.

FIG. 1 shows a squirt kayak using the cockpit cover of the preferred embodiment of the invention. The kayak 10 has a hull 12 which is a buoyant shell forming its bottom and side structure, and a deck 14 which is the top surface that encloses the hull 12. The cockpit 18, illustrated in FIG. 2, is an opening in the deck 14 which will accommodate a sitting paddler. The cockpit 18 shown in the illustrations of the preferred embodiment is an elongated opening in the deck 14 extending past the feet of the seated paddler. A more conventional cockpit would have a circular or oval shape.

The invention in its preferred embodiment uses a combination of an improved cockpit cover 30 and a tubular channel 20 which is molded into the kayak deck 14 at the perimeter of the cockpit 18.

Figure 3:
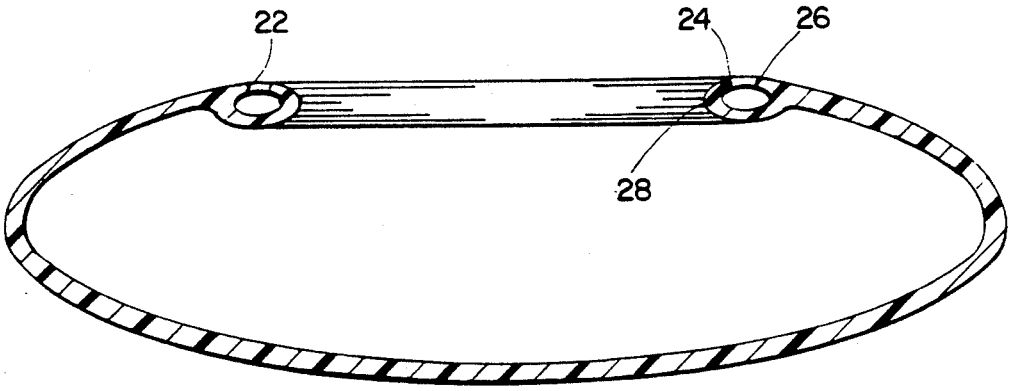
FIG. 3 is a section view along line 3—3 of FIG. 2.

The tubular channel 20, which replaces the conventional raised rim of the prior art, is shown in FIG. 3. The tubular channel 20 does not interrupt the plane of the upper surface of the deck 14. The channel slot 22 in the surface of the deck 14 is a continuous opening of uniform width around the perimeter of the cockpit 18 which is defined by inner and outer slot edges 24 and 26. The curved interior wall 28 of the tubular channel 20 defines a space having an approximately circular cross section with the center line of the circular cross section held at a constant distance below the surface of the deck 14. The distance between the inner and outer slot edges 24 and 26 is smaller than the diameter of the circular cross section defined by the channel wall 28 below the surface of the deck 14.

Figure 4:
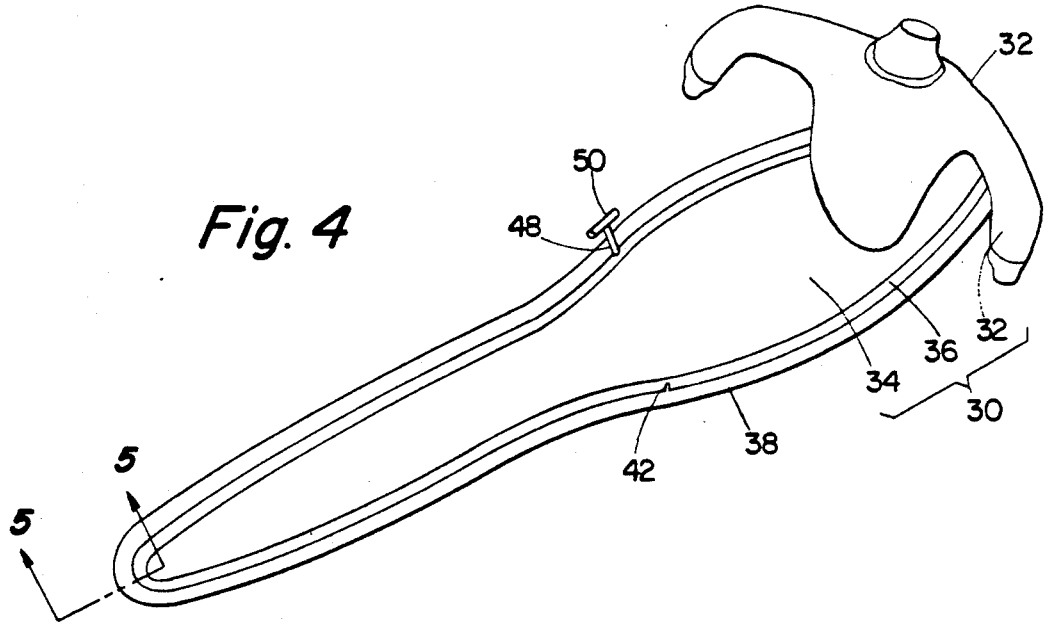
FIG. 4 is a prespective view of the cockpit cover of the invention.
Figure 5:
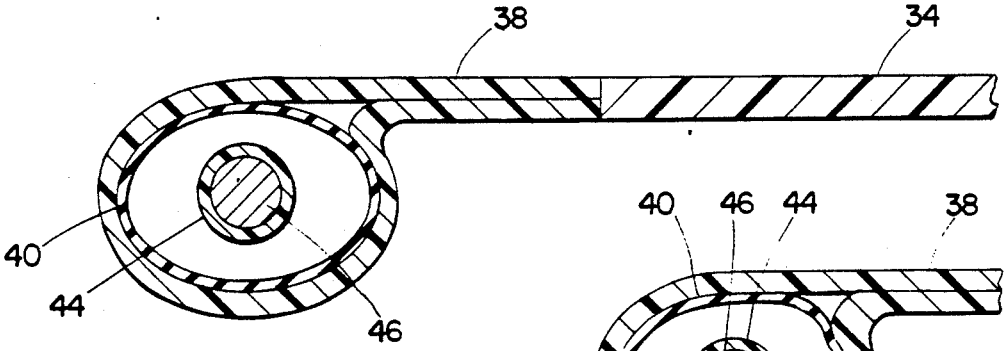
FIG. 5 is a section view along line 5—5 of FIG. 4.
Figure 6:
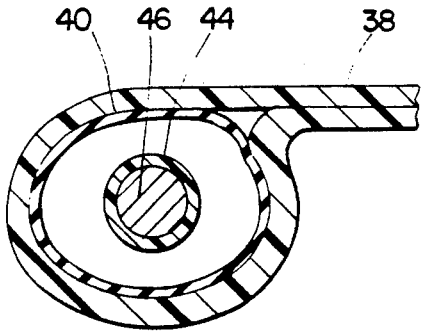
FIG. 6 is a section view along line 5—5 of FIG. 4, showing the inflation of the inflatable tube.
Figure 7:
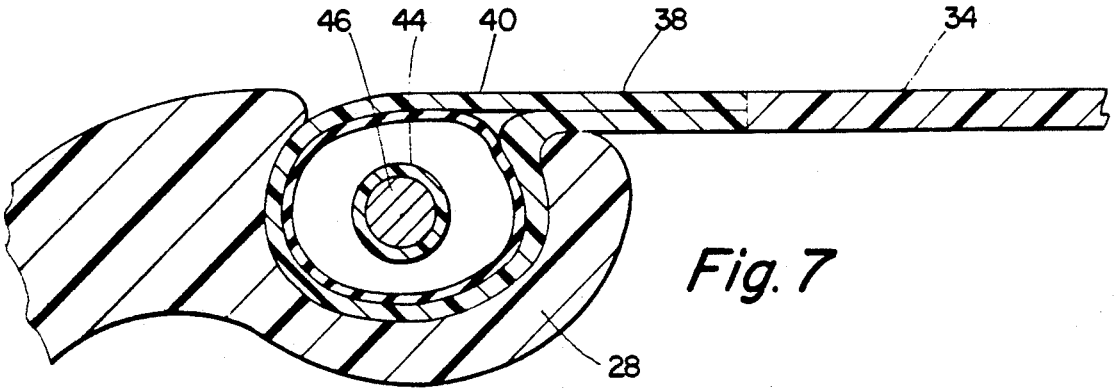
FIG. 7 is a section view showing the cockpit cover of the invention retained in a channel constructed according to the invention.
Figure 8:
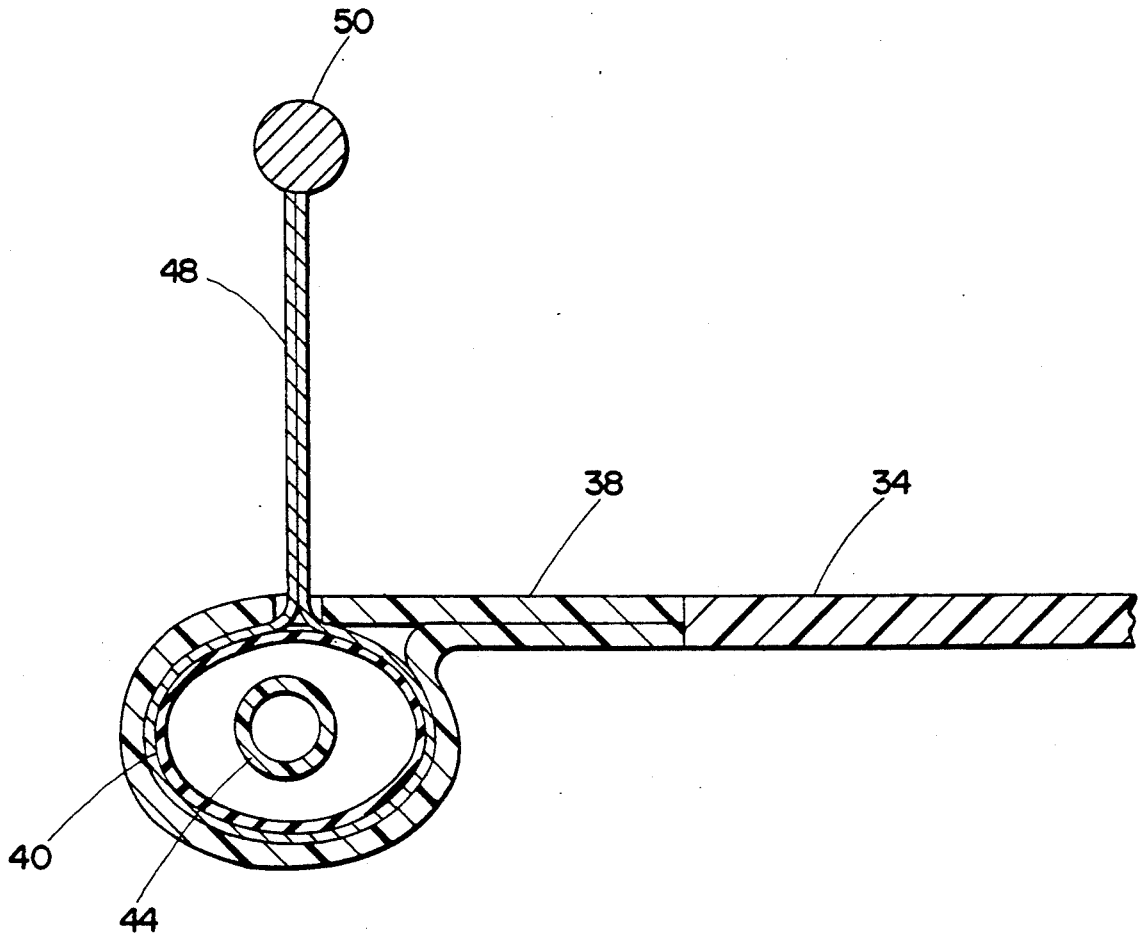
FIG. 8 is a section view showing the tube-constricting end of the release loop in relation to other elements of the invention.

FIG. 4 shows the cockpit cover 30 of the preferred embodiment of the invention. The material of the cockpit cover 30 is nylon covered neoprene. The waist closure 32 of the preferred embodiment is a waterproof upper body garment or dry top which is worn by the paddler. The dry top is constructed integrally with the cover 30 and provided with watertight latex seals at the neck and arms. An alternative waist closure 32 is a fitted tube that snugly surrounds the waist of the paddler to form a watertight seal. The planar covering section 34 is joined to the waist closure 32 and spans the cockpit 18 around the paddler. At the outside of the covering section 34 is a sealing edge assembly 36 which is complementary to the tubular channel 20 in the deck 14.

The sealing edge assembly 36 of the cockpit cover 30 has a fixed length which is equal to the length of the tubular channel 20 in the deck 14. The edge assembly 36 includes a doubled section of fabric forming an endless sleeve 38 at the outer margin of the covering section 34. The sleeve 38 carries within it an endless resilient inflatable tube 40 which is provided with a valve element 42 by which the tube 40 can be inflated and deflated. The valve element 42 is positioned so that it protrudes through the sleeve 38 adjacent to the topside of the covering section 34 and is readily within the reach of the paddler seated in the kayak 10. The valve element 42 is suitable for inflation by a hand pump or compressed gas inflating device.

In the preferred embodiment of the invention, the sealing edge assembly 36 has two additional features which aid in the installation of the cockpit cover 30, and particularly adapt it for use with the elongated cockpit 18 shown in the illustrations. First, the inflatable tube 40 carries within it a linear flexible core element 44, of relatively non-stretchable material. The core element 44 enables the paddler to readily grasp and manipulate the sealing edge assembly 36 for installation. The flexible core element 44 has its ends joined inside the inflatable tube 40, and it fixes the length of the edge assembly 36. The core element 44 of the preferred embodiment is a segment of vinyl tubing.

In addition, the inflatable tube 40 contains a rigid shaping extension 46. The rigid shaping extension 46 is formed into a shape congruent with the forward portion of the tubular channel 20 which is most remote from the paddler due to the elongation of the cockpit 18. The purpose of the rigid shaping extension 46 is to enable the paddler to guide the sealing edge assembly 36 of the cockpit cover 30 into the forward section of the tubular channel 20 while the paddler is seated in the cockpit 18. In the preferred embodiment of the invention, the rigid shaping extension 46 is a U-shaped segment of brass wire, and the ends of the rigid shaping extension 46 fit into the tubing of the core element 44 to complete the loop of the core element 44.

To install the preferred embodiment of the cockpit cover 30, the section of the edge assembly 36 defined by the rigid shaping extension 46 is first inserted into the forward section of the tubular channel 20, then the core element 44 is used to guide the remainder of the edge assembly 36 into the channel 20. When the sealing edge assembly 36 has been installed in the tubular channel 20 around the entire perimeter of the cockpit 18, the paddler inflates the inflatable tube 40. The inflated tube 40 creates a watertight seal by expanding to firmly hold the fabric of the sleeve 38 against the inside of the tubular channel 20. The inflated tube 40 also secures the cover 30 in place, since the bulk of the expanded inflatable tube 40 will not pass between the inner and outer slot edges 24 and 26 under ordinary conditions of use.

For emergency exit from the kayak 10, the preferred embodiment of the cockpit cover 30 is provided with a release loop 48. The release loop 48 is a piece of nylon webbing which enters the fabric sleeve 38 at the topside of the cover 30, wraps once around the inflatable tube 40, and exits the sleeve 38 at its point of entry. The nylon webbing of the release loop 48 is sewn together to secure it around the inflatable tube 40, and the webbing ends in a terminal toggle 50. To release the cockpit cover 30 from the tubular channel 20, the paddler can pull sharply on the toggle 50 to locally constrict the inflatable tube 40 and draw the inflatable tube 40 out through the channel slot 22. Once started in this manner, the entire edge assembly 36 can be manually disengaged from the tubular channel 20. The localized force exerted by pulling the release loop 48 in an emergency is much greater than any force that will be exerted in ordinary use, since the forces on the cover 30 during ordinary use are distributed along the inflated tube 40 by the resilient fabric of the cockpit cover.

While the foregoing description specifically describes the preferred embodiment of the invention, it should not be construed to limit the scope of the invention. It will be seen by those skilled in the art that the cockpit cover disclosed herein can be constructed to complement other kayak designs while employing the principles of the invention. Many other variations are possible within the scope of the invention claims and their equivalents.

The invention claimed is:

1. A kayak cockpit cover comprising:

a waist closure means for watertight encirclement of the waist of a paddler occupying a cockpit in a kayak;

a fabric covering section for spanning the cockpit around the paddler, the covering section having an uppermost topside, an inner margin joined to the waist closure means and an outer margin;

a doubled portion of fabric at the outer margin of the covering section, the doubled fabric forming an endless fabric sleeve around the outer margin of the covering section;

an endless resilient inflatable tube carried within the fabric sleeve;

a valve element integral with the inflatable tube; and a linear flexible core element inside the inflatable tube.

2. The kayak cockpit cover of claim 1 wherein the ends of the core element are joined to form an endless loop inside the tube.

3. The kayak cockpit cover of claim 2 wherein the flexible core element is hollow and carries within it a rigid means for shaping a segment of the endless fabric sleeve.

4. The kayak cockpit cover of claim 1 including a release means for applying an external disengaging force, the release means having a graspable end at the topside of the cover and a tube-constricting end which encircles the inflatable tube within the fabric sleeve.

5. A kayak cockpit cover comprising:

a waist closure means for watertight encirclement of the waist of a paddler occupying a cockpit in a kayak;

a fabric covering section for spanning the cockpit around the paddler, the covering section having an uppermost topside, an inner margin joined to the waist closure means and an outer margin;

a doubled portion of fabric at the outer margin of the covering section, the doubled fabric forming an endless fabric sleeve around the outer margin of the covering section;

an endless resilient inflatable tube carried within the fabric sleeve;

a valve element integral with the inflatable tube; and a rigid means for shaping a segment of the endless fabric sleeve, the rigid means being carried within the fabric sleeve,

6. A kayak cockpit cover comprising:

a waist closure means for watertight encirclement of the waist of a paddler occupying a cockpit in a kayak;

a fabric covering section for spanning the cockpit around the paddler, the covering section having an uppermost topside, an inner margin joined to the waist closure means and an outer margin;

a doubled portion of fabric at the outer margin of the covering section, the doubled fabric forming an endless fabric sleeve around the outer margin of the covering section;

an endless resilient inflatable tube carried within the fabric sleeve;

a valve element integral with the inflatable tube; and a release means for applying an external disengaging force, the release means having a graspable end at the topside of the cover and a tube-constricting end which encircles the inflatable tube within the fabric sleeve.

7. A kayak cockpit cover for closing the cockpit of a kayak, the deck of the kayak having a tubular channel adapted for use with the cover, the cockpit cover comprising:

a waist closure means for watertight encirclement of the waist of a paddler occupying the cockpit in the kayak;

a fabric covering section for spanning the cockpit around the paddler, the covering section having an uppermost topside, an inner margin joined to the waist closure means and an outer margin;

a doubled portion of fabric at the outer margin of the covering section, the doubled fabric forming an endless fabric sleeve around the outer margin of the covering section;

an endless resilient inflatable tube carried within the fabric sleeve;

a valve element integral with the inflatable tube; and a linear flexible core element inside the inflatable tube;

whereby a seal may be created between the cockpit cover and the kayak deck by inserting the inflatable tube into the tubular channel and inflating the inflatable tube.

8. The kayak cockpit cover of claim 7 wherein the ends of the core element are joined to form an endless loop inside the tube.

9. The kayak cockpit cover of claim 8 wherein the flexible core element is hollow and carries within it a rigid means for shaping a segment of the endless fabric sleeve.

10. The kayak cockpit cover of claim 7 including a release means for applying an external disengaging force at a point location along the inflatable tube, the release means having a graspable end at the topside of the cover and a tube-constricting end which encircles the inflatable tube within the fabric sleeve.

11. For closing a cockpit in a kayak around a kayak paddler:

a kayak deck having a tubular channel formed at the perimeter of the cockpit, the channel comprising:

inner and outer channel edges in the plane of the deck at the cockpit perimeter, the edges defining a slot of uniform width; and a concavely curved channel wall which joins the inner and outer channel edges and forms a channel interior of uniform cross section below the plane of the deck, the width of the slot being smaller than the maximum width of the channel interior cross section; combined with a fabric cockpit cover complementary to the kayak deck, the cockpit cover comprising:

a waist closure means for watertight encirclement of the waist of the paddler;

a covering section for spanning the cockpit around the paddler, the covering section having an uppermost topside, an inner margin joined to the waist closure means and an outer margin;

a doubled portion of fabric at the outer margin of the covering section, the doubled fabric forming an endless fabric sleeve around the outer margin of the covering section;

an endless resilient inflatable tube carried within the fabric sleeve;

a valve element integral with the inflatable tube; and a linear flexible core element inside the inflatable tube;

whereby a seal is created between the cockpit cover and the kayak deck when the sleeve carrying the inflatable tube is inserted into the tubular channel and the inflatable tube is inflated within the tubular channel.

12. The invention of claim 11 wherein the ends of the core element are joined to form an endless loop inside the tube.

13. The invention of claim 12 wherein the flexible core element is hollow and carries within it a rigid means for shaping a segment of the endless fabric sleeve.

14. The invention of claim 11 wherein the cockpit cover includes a release means for applying an external disengaging force at a point location along the inflatable tube, the release means having a graspable end at the topside of the cover and a tube-constricting end which encircles the inflatable tube within the fabric sleeve.

* * * * *